United States Patent [19]

Kameya

[11] Patent Number: 4,583,062

[45] Date of Patent: Apr. 15, 1986

[54] ELECTROMAGNETIC DELAY LINE HAVING A COIL WITH DIVERGENT ADJACENT TURNS

[75] Inventor: Kazuo Kameya, Tsurugashima, Japan

[73] Assignee: Elmec Corporation, Saitama, Japan

[21] Appl. No.: 575,603

[22] Filed: Jan. 31, 1984

[30] Foreign Application Priority Data

Jan. 31, 1983 [JP] Japan ..... 58-14165
Apr. 28, 1983 [JP] Japan ..... 58-64304[U]

[51] Int. Cl.[4] ..... H01P 9/00

[52] U.S. Cl. ..... 333/138; 333/140; 333/156; 336/199

[58] Field of Search ..... 333/140, 138, 168, 167, 333/185, 156, 162, 163; 336/69, 189, 190, 191, 199, 198

[56] References Cited

U.S. PATENT DOCUMENTS 2,703,389 3/1955 Schwartz, Jr. ..... 333/140
3,908,177 9/1975 Kameya ..... 333/138
4,004,179 1/1977 Phillips ..... 333/163 X
4,160,962 7/1979 de Keyser et al. ..... 333/156 X
4,272,741 6/1981 Vanderknyff ..... 333/140 X
4,313,474 2/1982 Nazet et al. ..... 333/162 X
4,453,144 6/1984 Tamura et al. ..... 333/140

*Primary Examiner*—Eugene R. LaRoche
*Assistant Examiner*—Benny T. Lee
*Attorney, Agent, or Firm*—Sughrue, Mion, Zinn, Macpeak & Seas

[57] ABSTRACT

An electromagnetic delay line is disclosed which is provided with an inductance element formed by a conductor winding with capacitors arranged between the inductance element and ground dividing the element into a plurality of sections. These sections are formed of loops resulting from the winding of the conductor and the loops of adjacent sections are formed in opposed planes divergent in alternately opposite directions. The electromagnetic delay line acquires the optimum coupling coefficient between the sections and achieves advantageous delay characteristics in a wide frequency band including the ultra-high frequency band. Particularly, it obtains the ultra-high speed rise time of less than 1 ns.

9 Claims, 15 Drawing Figures

(A)

(B)

ELECTROMAGNETIC DELAY LINE HAVING A COIL WITH DIVERGENT ADJACENT TURNS

BACKGROUND OF THE INVENTION (1) Field of the Invention

This invention relates to an electromagnetic delay line combining an inductance element formed by a conductor winding and capacitors, and more particularly to improvements in and concerning an electromagnetic delay line which permits the selection of a delay time within a wide range, exhibits a rapid rise time and minimal distortion in the output waveform within the range of delay times and is suited for use in a digital circuit.

(2) Description of the Prior Art

Among conventional electromagnetic delay lines, there is known a delay line which has an inductance element formed by coiling a conductor in the shape of a single-layer solenoid on a bar-shaped bobbin. This inductance element is divided into a plurality of sections by interposing capacitors between the conductor and ground at intervals of a fixed number of turns of the coiled conductor of the inductance element.

In this electromagnetic delay line the delay characteristics thereof in terms of the quickness of rise time and the distortion of output waveform are improved by setting the coupling coefficient between the adjacent sections of the inductance element at a value on the order of 0.1 to 0.2, the coupling coefficient between sections separated by one intervening section at a value on the order of −0.02 to −0.03, the coupling coefficient of every successive odd-numbered section at a proper positive value, and the coupling coefficient of every successive even-numbered section at a proper negative value.

With the prior electromagnetic delay line constructed as described above, however, it has been difficult for the inductance element to obtain the optimum coupling conditions described above in an ultra-high frequency band, such as, for example, a band exceeding frequencies of 1 GHz. Thus, it has been accepted as infeasible that a delay line capable of producing a rise time not exceeding 1 ns could be obtained.

The present inventor has diligently studied this matter with a view to solving this difficulty. He has consequently found that the inductance element can be easily made to acquire the optimum coupling conditions in the ultra-high frequency band by elaborately coiling the conductor and suitably designing the configuration of the conductor of the delay line.

SUMMARY OF THE INVENTION

This invention is primarily aimed at providing an electromagnetic delay line which readily permits an inductance element to obtain the aforementioned optimum section-to-section coupling coefficients within a wide frequency band, and which enjoys advantageous delay characteristics in terms of the rise time and the distortion of output waveform.

An object of this invention is to provide an electromagnetic delay line which exhibits the aforementioned advantageous delay characteristics in an ultra-high frequency band, having a rise time of not more than 1 ns.

Another object of this invention is to provide an electromagnetic delay line of simple construction.

Yet another object of this invention is to provide an electromagnetic delay line which is easy to manufacture because the coiling of the conductor is easy to accomplish.

A further object of this invention is to provide an electromagnetic delay line which is inexpensive to produce.

To accomplish the objects described above, this invention provides an electromagnetic delay line comprising an inductance element formed by a coiled conductor and capacitors arranged between the conductor and ground, and, therefore, possessing a plurality of sections. The sections of the electromagnetic delay line are each formed of loops of the aforementioned coiled conductor, with adjacent loops of the coil being formed in opposed planes diverging in alternately opposite directions.

With the structure contemplated by this invention as described above, optimum coupling conditions between the sections of the inductance element can be easily selected within a wide frequency band, particularly in an ultra-high frequency band, and the electromagnetic delay line as a whole can achieve the aforementioned advantageous delay characteristics.

DETAILED DESCRIPTION OF THE PREFERRED EMBODIMENT

The present invention will be described in detail below.

Figure 1:
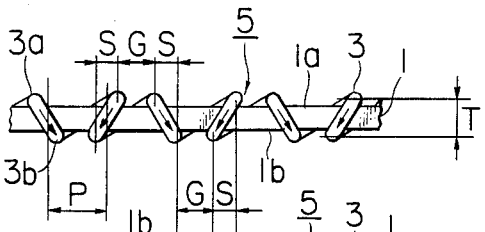
FIG. 1 is a top view illustrating part of a typical electromagnetic delay line according to the present invention.
Figure 2:
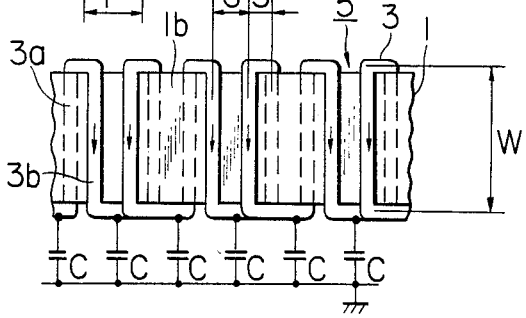
FIG. 2 is a schematic front view of the electromagnetic delay line of FIG. 1.
Figure 3:
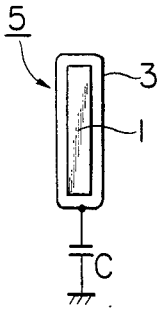
FIG. 3 is a schematic side view of the electromagnetic delay line illustrated in FIG. 1.

FIGS. 1–3 illustrate one embodiment of the present invention. In these diagrams, a bar-shaped bobbin 1 made of a nonmagnetic material has a flat rectangular cross section in which the size in the direction of width W is significantly greater than the size in the direction of thickness T. A conductor 3 is coiled in the manner of a single-layer solenoid on the periphery of the bobbin 1 to form an inductance element 5. Precisely, the dimensions of width W and thickness T represent the distance between the centers of the opposed portions of the conductor 3 on either side of the bobbin 1.

The inductance element 5 is formed by coiling the conductor 3 at a given pitch P in the manner of a single-layer solenoid on the periphery of the bobbin 1, spacing the portions of the conductor 3 on the thickness T side at a given interval S and biasing these portions in alternately opposite directions, and disposing the portions of the conductor 3 in a parallel manner on the opposite width W sides 1A, 1B of the bobbin 1. The interval G between adjacent parallel portions of the conductor 3 on the width W side 1*a* of the bobbin 1 is smaller than the interval between adjacent parallel portions of the conductor 3 on the directly opposite portion of side 1*b* of the bobbin 1. Consequently, the conductor 3 is coiled so that the intervals between adjacent parallel portions of the conductor 3 are alternately widened and narrowed on the opposite width W sides 1*a*, 1*b* of the bobbin 1. Moreover, one turn of the conductor 3 coiled on the width W side 1*a* through the opposite width W side 1*b* of the bobbin 1 constitutes one loop and the adjacent loops formed by successive turns of the conductor 3 form opposed planes diverging in alternately opposite directions. The pitch P and the intervals S and G indicated in FIG. 1 are so related as to satisfy the expressions $S=P-G$ and $G<P$. The arrows drawn on the conductor 3 indicate the direction of flow of electric current.

In this inductance element 5, as illustrated in FIG. 2, the conductor 3 is grounded via capacitors C, one connected for each turn of the conductor 3 on one side of the bobbin 1, to form a lumped-constant type electromagnetic delay line. This electromagnetic delay line possesses a plurality of sections, with each of the turns of the conductor 3 serving as an inductance of one section. Since the width W is significantly larger than the thickness T, the inductance in each of the sections is preponderantly determined by the portions of the conductor 3 running in the width W direction.

Figure 4:
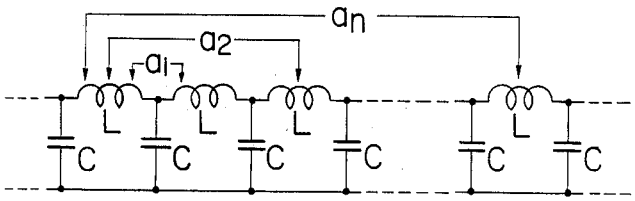
FIG. 4 is an equivalent circuit diagram of the electromagnetic delay line illustrated in FIGS. 1–3.

FIG. 4 represents part of an equivalent circuit diagram of the electromagnetic delay line, wherein a plurality of inductances L and capacitances C are connected in the shape of a ladder. The symbol $a_1$ denotes a coupling coefficient between two adjacent inductances L, e.g., between the first and second inductances L, the symbol $a_2$ a coupling coefficient between two inductances L separated by one intervening inductance, e.g., between the first and third inductances, and the symbol $a_\eta$ a coupling coefficient between the first and the n-th inductances L. FIG. 4 illustrates the coupling relations of the leftmost inductance L with other inductances L. Actually, there are other inductances L falling to the left of the leftmost inductance L, and this leftmost inductance is coupled with such other inductances L. By the same token, each of the other inductances L illustrated is similarly coupled with the other inductances L.

Now, the couplings in the inductance element 5 of the electromagnetic delay line constructed as described above will be explained.

Figure 5:
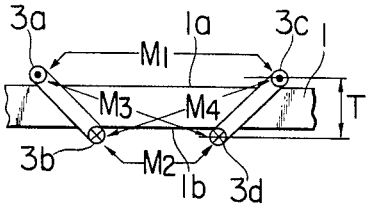
FIG. 5(A) and FIG. 5(B) are diagrams explaining coupling relations in the inductance element illustrated in FIG. 1.
Figure 5:
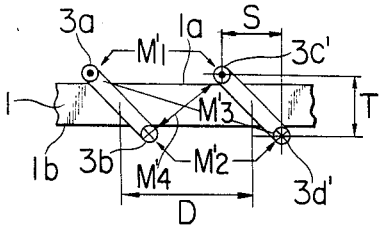

The positional relation between the leftmost section formed of the portions of the conductor 3*a*, 3*b* and the sections to the right thereof illustrated in FIG. 1 is as shown in FIGS. 5(A) and 5(B). For example, this leftmost section taken as the origin and an odd-numbered section assume a condition in which the loops of the respective sections are divergent as illustrated in FIG. 5(A). The leftmost section and an even-numbered section assume a condition in which their respective loops run parallel with each other as illustrated in FIG. 5(B).

Now with reference to FIG. 5(A), $M_1$ stands for the mutual inductance between the portions 3*a*, 3*c* of the conductor, $m_2$ for the mutual inductance between the portions 3*b*, 3*d* of the conductor, $M_3$ for the mutual inductance between the portions 3*a*, 3*d* of the conductor, and $M_4$ for the mutual inductance between the portions 3*b*, 3*c* of the conductor. Since the electric current flows through the portions 3*a*, 3*c* of the conductor in the same direction, the mutual inductances $M_1$, $M_2$ constitute a positive coupling. Since the electric current flows through the portions 3*b*, 3*d* and the portions 3*a*, 3*c* of the conductor in opposite directions, the mutual inductances $M_3$, $M_4$ constitute a negative coupling. Here, the mutual inductances, $M_1$ through $M_4$, are expressed in absolute values. Between the section formed of the portions 3*a*, 3*b* of the conductor and the section formed of the portions 3*c*, 3*d* of the conductor, therefore, there exists a mutual inductance of the value of $M_1+M_2-M_3-M_4$. In view of the relation of the distances between the portions 3*a* through 3*d* of the conductor, these mutual inductances have values satisfying the expressions $M_2>M_3>M_1$, $M_3=M_4$. Upon theoretical analysis, it will be ascertained that the coupling between the section formed of the portions 3*a*, 3*b* of the conductor and the section formed of the portions 3*c*, 3*d* of the conductor is positive at all times.

With reference to FIG. 5(B), $M_1'$ stands for the mutual inductance between the portions 3*a*, 3*c*′ of the conductor, $M_2'$ for the mutual inductance between the portions 3*b*, 3*d*′ of the conductor, $M_3'$ for the mutual inductance between the portions 3*a*, 3*d*′ of the conductor, and $M_4'$ for the mutual inductance between the portions 3*b*, 3*c*′. Since the electric current flows through the portions 3*a*, 3*c*′ of the conductor in the same direction and through the portions 3*a*, 3*c*′ and the portions 3*b*, 3*d*′ in mutually opposite directions, the mutual inductances $M_1'$, $M_2'$ constitute a positive coupling and satisfy the expression $M_1'=M_2'$ and the mutual inductances $M_3'$, $M_4'$ constitute a negative coupling and satisfy the expression $M_4'>M_3'$. Here, the mutual inductances $M_1'$ through $M_4'$ are expressed in absolute values.

Consequently, the mutual inductance between the section formed of the portions 3*a*, 3*b* of the conductor and the section formed of the portions 3*c*′, 3*d*′ assumes a value expressed by $M_1'+M_2'-M_3'-M_4'$. When the distance D between these two sections in the axial direction of the bobbin 1 is small, the coupling between these two sections assumes a positive value because the expression $M_1'+M_2'-M_3'-M_4'>0$ is satisfied. As the distance D is increased to satisfy the expression $M_1'+M_2'-M_3'-M_4'<0$, however, the coupling between the two sections assumes a negative value. The relation between the mutual inductance and the distance D is such that when the distance D is smallest, the mutual inductance assumes the largest positive value, and as the distance D is increased, the mutual inductance approaches 0 and then becomes increasingly negative. The degree of this change in the mutual inductance is such that the distance D at which the reversal of the mutual inductance to a negative value occurs decreases, and the absolute value of the minimum value increases proportionally as the thickness T of the bobbin 1 is decreased with the interval S of the conductor 3 kept unchanged, for example. Moreover, because the distance D, indicated in FIG. 5(B) between the most juxtaposed sections, i.e., the length of the second inductance, equals two times the pitch (2P), negative coupling can be easily obtained.

On synthesis of the foregoing various considerations, it is obvious that the coupling coefficients $a_1, a_3, a_5, \ldots$ between the odd-numbered sections satisfy the expression $a_1 > a_3 > a_5 \ldots > 0$ and the coupling coefficients $a_2, a_4, a_6, \ldots$ between the even-numbered sections satisfy the expressions $a_2 < a_4 < a_6 \ldots < 0$. Further, the electromagnetic delay line as a whole may be enabled to acquire a desirable delay characteristic, namely, a quick rise time and minimal distortion of the output waveform, because the coupling coefficients $a_1, a_2, a_3, \ldots$ can be easily selected at their optimum values by adjusting the diameter and dimensions of the conductor 3. Moreover, by properly selecting the dimensions of the bobbin 1 and the conductor 3, the aforementioned optimum coupling coefficients can be easily obtained even in an ultra-high frequency band. This attainment is ascribable to the fact that the loops of the adjacent sections form opposed planes divergent in alternately opposite directions.

Using the aforementioned configuration illustrated in FIG. 1–3, the inventor prepared a delay line of 20 sections by coiling a conductor 3 of a diameter of 0.1 mm a total of 20 turns on a bobbin 1 under the conditions W=13 mm, T=0.2 mm, P=1.5 mm, and G=0.23 mm and by connecting 20 pF capacitors between each turn of the conductor and ground. Consequently, there was obtained a delay time of 500 ps per section, or 10 ns total, and a characteristic impedance of 50 Ω. In this case, the design values of the coupling coefficients were $a_1=0.15995$, $a_2=-0.02049$, $a_3=0.00829$, $a_4=-0.00383$, $a_5=0.00236$, $a_6=-0.00137$, indicating that the phase delay distortion can be suppresed within 1% in the range of 90% of the theoretical cutoff frequency of 930 MHz.

In the embodiment described above, the inductance element 5 is formed by coiling the conductor 3 around the bobbin 1. Alternatively, the inductance element 5 may be formed by forming a conductor layer as by plating on the surface of a bobbin made of alumina ceramic, for example, and by subsequently subjecting the coated surface of the bobbin to mechanical grinding, photoetching, or laser-beam processing instead of winding the conductor 3 on the bobbin.

Figure 6:
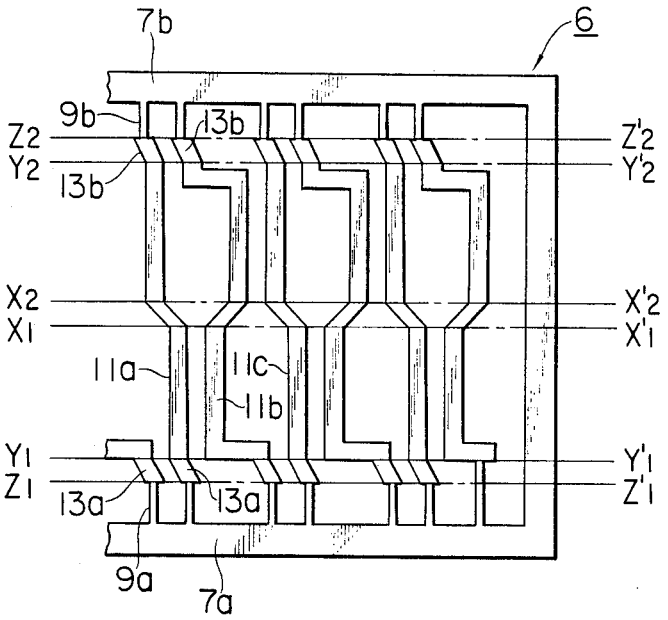
FIG. 6 is a partially developed diagram of an inductance element used in another typical electromagnetic delay line of this invention.
Figure 7:
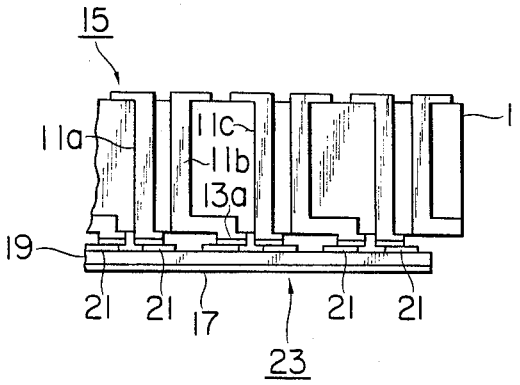
FIG. 7 is a front view illustrating part of a typical electromagnetic delay line using the inductance element illustrated in FIG. 6.
Figure 8:
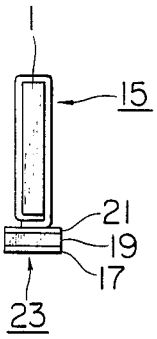
FIG. 8 is a side view of the electromagnetic delay line illustrated in FIG. 7.

A configuration as illustrated in FIGS. 6–8 is also feasible. FIGS. 6–8 represent another embodiment of this invention. In this embodiment, a conductor pattern 6 for use as an inductance element is formed by subjecting one large conductive foil to an etching treatment.

To be more specific, a conductor pattern 6 is integrally formed by arranging a plurality of conductor strips 11*a*, 11*b*, 11*c*, . . . through the medium of support pieces 9*a*, 9*b* between opposed frame sides 7*a*, 7*b* as illustrated in FIG. 6. It is assumed that four imaginary lines, $Y_1$–$Y_1'$, $Z_1$–$Z_1'$, $Y_2$–$Y_2'$, and $Z_2$–$Z_2'$, intersect the conductor strips 11*a*, 11*b*, 11*c*, . . . along the boundaries between the support pieces 9*a*, 9*b* and the conductor strips 11*a*, 11*b*, 11*c*, . . . and along lines slightly toward the conductor strips, and the two imaginary lines, $X_1$–$X_1'$, and $X_2$–$X_2'$, intersect the conductor strips 11*a*, 11*b*, 11*c*, . . . at a small distance from each other along the center between the frame sides 7*a*, 7*b*. The adjacent conductor strips 11*a*, 11*b* are separated by a smaller interval between the imaginary lines, $X_1$–$X_1'$ and $Y_1$–$Y_1'$, diverge obliquely between the imaginary lines, $X_1$–$X_1'$, and $X_2$–$X_2'$, and are separated by a larger interval between the imaginary lines, $X_2$–$X_2'$, and $Y_2$–$Y_2'$. The conductor strips 11*b*, 11*c* are formed so that the relation of small and large intervals is reversed from that of the conductor strips 11*a*, 11*b*. In FIG. 6, the symbols 13, 13*b*, . . . denote connecting pieces formed at the ends of the conductor strips 11*a*, 11*b*, 11*c*, . . .

An inductance element 15 having these conductor strips 11*a*, 11*b*, 11*c*, . . . wound in the manner of a single-layer solenoid as illustrated in FIG. 6 and FIG. 7 is obtained by winding the conductor strips 11*a*, 11*b*, 11*c*, . . . on the periphery of a flat bobbin 1 similar to the bobbin of FIG. 1 with the conductor strips 11*a*, 11*b*, 11*c*, . . . bent at right angles along the imaginary lines $X_1$–$X_1'$, $X_2$–$X_2'$, $Y_1$–$Y_1'$, and $Y_2$–$Y_2'$, cutting the connecting pieces 13*a*, 13*b* from the frame sides 71, 7*b*, and connecting the cut connecting pieces 13*a*, 13*b* in a superposed form. A composite capacitor 23 having electrodes 21 arranged spaced with a fixed pitch is formed on one side of a dielectric plate 19 having a ground electrode 17 formed on the other side thereof. The electrodes 21 disposed on the composite capacitor 23 are connected to where the aforementioned connecting pieces 13 are superposed, to form an electromagnetic delay line possessing a plurality of sections.

In the electromagnetic delay line constructed as described above, the conductor strips 11*a*, 11*b*, 11*c*, . . . are bent in the shape of loops constituting individual sections of the electromagnetic delay line. Since the loops of the adjacent sections are in the form of opposed planes divergent in alternately opposed directions, the electromagnetic delay line as a whole acquires an advantageous delay characteristic.

Figure 9:
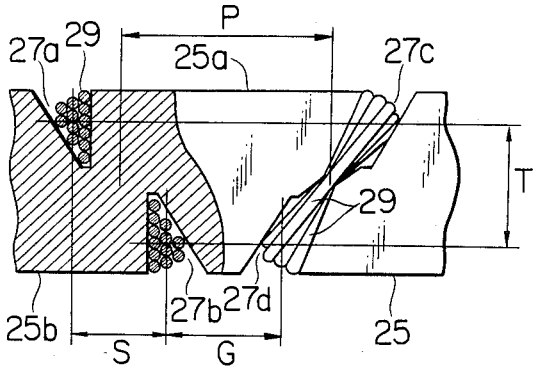
FIG. 9 is a partially sectioned schematic top view illustrating yet another typical electromagnetic delay line of the present invention.

FIG. 9 represents yet another embodiment of this invention. In the opposite surfaces of the larger width, namely the upper surface 25*a* and the lower surface 25*b* as illustrated in the diagram, of a flat bobbin 25, grooves 27*a*, 27*b*, 27*c*, 27*d*, . . . each of a wedge-shaped cross section (the shape of the letter V) are formed in the width direction. These grooves 27*a*, 27*b*, 27*c*, 27*d*, . . . are disposed so that the distances between the adjacent grooves are alternately widened and narrowed in the upper surface 25*a* of the bobbin 25 and are similarly alternately widened and narrowed in the lower surface 25*b*. Where the grooves 27*a*, 27*c* separated by a wider interval are formed in the upper surface 25*a*, for example, the grooves 27*b*, 27*d* separated by a narrow interval are formed in the lower surface 25*b* of the bobbin 25. This relation of wide and narrow intervals is alternated in the upper and lower surfaces 25*a*, 25*b*. One section of the inductance element is formed by coiling the conductor 29 a plurality of turns in the grooves 27*a*, 27*b* and an adjacent section is formed by coiling the conductor 29 a plurality of turns in the grooves 27*c*, 27*d*.

Again in the electromagnetic delay line constructed as described above, each section of the delay line is formed by coiling the conductor 29 to form a loop of a plurality of turns. The adjacent loops are formed as opposed planes divergent in alternately opposite directions. The electromagnetic delay line of this configuration, therefore, permits setting of the optimum coupling coefficients.

Since this electromagnetic delay line is formed by coiling the conductor 29 a plurality of turns in the grooves of the bobbin 25, the portions of the inductance L for the individual sections are enabled to assume large values and the delay line thus formed can acquire a relatively large delay time. Since the grooves have a wedge-shaped cross section, the portions of the conductor 3 wound in these grooves are wound tightly enough to ensure stabilization of the delay characteristics.

Figure 10:
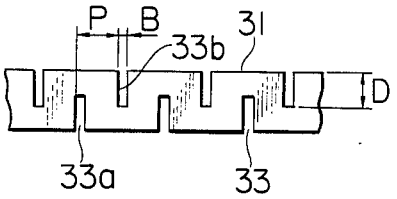
FIG. 10 is a top view illustrating part of a bobbin used in still another typical electromagnetic delay line of the present invention.
Figure 11:
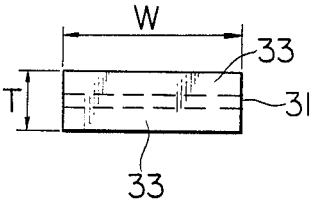
FIG. 11 is a side view of the bobbin illustrated in FIG. 10.
Figure 12:
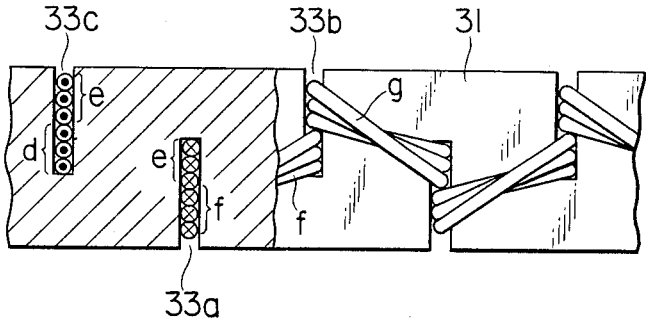
FIG. 12 is a partially sectioned schematic partial top view illustrating an electromagnetic delay line using the bobbin of FIG. 10.

FIG. 10 through FIG. 12 represent a further embodiment of the present invention.

A bobbin 31 made of a non-magnetic material is provided in the shape of a flat, slender bar having a rectangular cross section whose size in the direction of width W is significantly larger than the size thereof in the direction of thickness T, as illustrated in FIG. 10 and FIG. 11. In the main opposite surfaces of this bobbin 31 in the direction of width W thereof (the upper and lower surfaces in the diagram), grooves 33 are alternately formed perpendicularly to the axial direction of the bobbin 31 and are spaced at a given pitch P. Relative to the groove 33*a* formed in one surface of the bobbin 31 (the lower surface in the diagram), the next groove 33*b* is formed in the opposite surface (the upper surface in the diagram) at a position distanced by the pitch P, and successive grooves are alternately formed in the opposite surfaces separated by the fixed pitch P. All these grooves 33 have a width B and a depth D. Particularly, the width B is equal to or slightly greater than the diameter of the conductor.

An electromagnetic delay line using this bobbin 31 is constructed as illustrated in FIG. 12. In the groove 33*c* of the bobbin 31, the winding d of the conductor for a section situated to the left of the winding e of the conductor forming a given section is spirally wound three turns. In this groove 33*c* and the groove 33*a* separated therefrom by the pitch P, the winding e of the conductor is spirally wound three continuous turns, superposed on the winding d of the conductor inside the groove 33*c*, to form another section. In the groove 33*a* and the groove 33*b* separated therefrom by the pitch P, the winding f is spirally wound three continuous turns, superposed on the winding e inside the groove 33*a*, to form yet another section. The successive windings g, . . . are formed similarly in the successive grooves. In this manner, each groove 33 concurrently serves as part of the groove of the adjacent section, and any two adjacent sections share part of a relevant conductor winding.

The points of the conductor at which the windings d, e, f, g, . . . shift to the respectively following windings e, f, g, . . . are connected with capacitors (not shown) to ground, to form the aforementioned electromagnetic delay line having a plurality of ladder-like sections. In the electromagnetic delay line constructed as described above, the individual sections are formed with windings d, e, f, g, . . . , each wound a plurality of turns in the shape of a loop, and these loops are divergent in alternately opposite directions. Thus, the coupling coefficients of the aforementioned optimum values and signs can be easily obtained by suitably selecting the length of the pitch P, the number of turns of the conductor, the diameter of the conductor, etc. The electromagnetic delay line consequently produced will enjoy advantageous delay characteristics.

Further, the bobbin 31 on which the conductor is wound enjoys a simplicity of shape as compared with that used in the electromagnetic delay line of FIG. 9 because it incorporates the grooves 33 formed alternately in the opposite surfaces thereof, spaced at a fixed pitch. Thus, the metal mold used for molding the bobbin 31 would be inexpensive, owing to the simplicity of the shape of the bobbin. The loops of the windings d, e, f, g, . . . can be easily formed by keeping the bobbin 31 held fast as in a chuck of a coil winder, rotating the bobbin 31, thereby allowing the conductor to be wound thereon one-half turn, subsequently shifting the bobbin 31 or the conductor by a distance of one pitch and again allowing the conductor to be wound on the bobbin one-half turn, and repeating this procedure. Thus, the winding work can be simplified and cost of production lowered proportionally. Since the windings of conductor to be wound for any two adjacent sections share one groove situated on the boundary of the two sections, the number of grooves can be decreased and the overall size of the electromagnetic delay line proportionally decreased.

Figure 13:
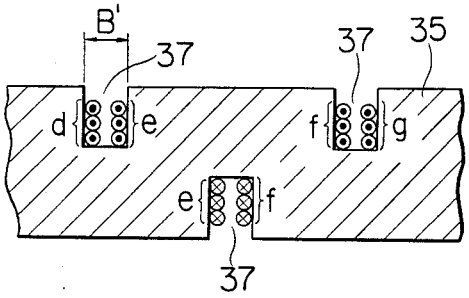
FIG. 13 and FIG. 14 are schematic partial cross sections illustrating modifications of the electromagnetic delay line of FIG. 12.
Figure 14:
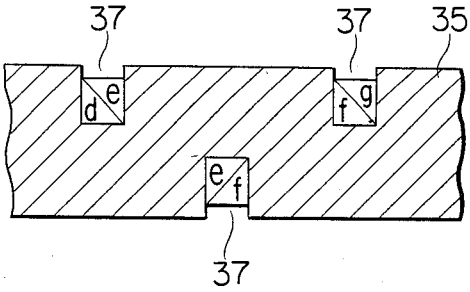

FIG. 13 and FIG. 14 are cross sections illustrating, in part, modifications of the aforementioned electromagnetic delay line of FIG. 12.

These electromagnetic delay lines are constructed by using bobbins 35 in which grooves 37 of a slightly larger width B′ than the diameter of the conductor are formed in the manner illustrated in FIG. 10. The electromagnetic delay line of FIG. 13 is constructed by having the adjacent windings d∼g, . . . spirally wound but not superposed inside the grooves 37. The electromagnetic delay line illustrated in FIG. 14 is constructed by allowing the windings of conductor wound earlier to occupy lower diagonally severed spaces inside the grooves 37, and the windings wound later to occupy the remaining upper diagonally severed spaces. Particularly, the electromagnetic delay line of FIG. 14 takes advantage of the fact that the windings d∼g, . . . of conductor wound as described above are inherently stretched diagonally inside the grooves 37 and, therefore, proves convenient where a conductor of a relatively small diameter is required to be wound a large number of turns.

All of the electromagnetic delay lines of this invention described above attain the objects of this invention as long as the individual sections of the inductance element are formed by winding the relevant windings of conductor in the shape of loops and the loops of the adjacent sections are divergent in alternately opposite directions. The loop of a section is formed of one turn of conductor where such one turn constitutes one section, or of a plurality of turns of conductor where such plurality of turns constitutes one section. Where each of the sections is formed by winding the conductor in the shape of a solenoid or by randomly winding the conductor, it suffices to regard the totality of turns of conductor used in the section as one single loop.

For simplicity of illustration, the various embodiments cited above have been described on the assumption that the bobbins 1 used therein have a greater size in the direction of width W than in the direction of thickness T and, therefore, the effects manifested by the windings of conductor falling on the thickness T sides are negligibly small. In reducing any of the electromagnetic delay lines contemplated by this invention to practice, the designer will take due consideration of the windings of conductor falling on the thickness t sides as well. The bobbin is not always required to have a flat shape. When desired, a bobbin having an elliptic cross section or a circular cross section may be used. The material of the bobbin is not always limited to that of a nonmagnetic substance. These factors may be suitably selected depending on the magnitude of the frequency actually involved. Further, the inductance element is not necessarily limited to the winding of the conductor on a bobbin. Optionally, it may be formed as a coreless construction without the use of a bobbin. It is also permissible for the individual sections of the inductance element to be formed with the respective windings of conductor wound on separate bobbins.

In the aforementioned electromagnetic delay lines, the individual sections of the inductance element are formed by connecting a capacitor at intervals of a certain integer number of turns of conductor. Optionally, the individual sections of the electromagnetic delay lines of this invention may be formed by connecting such capacitors at intervals of certain fractions of turns, such as 1.5 turns of conductor.

In accordance with this invention, a distributed-constant type delay line may be produced by providing a capacitor-forming conductor for the inductance element.

What is claimed is:

1. An electromagnetic delay line, comprising;

an inductance element comprising a conductor winding, said conductor being wound so as to form serially connected conductor loops, said loops each including at least one substantially complete turn, and a common axis passing through each of said loops;

a plurality of capacitors disposed between said conductor and ground, at least one capacitor being provided at each location between adjacent ones of said loops;

a plurality of conductor sections, each section being defined by a conductor loop arranged between adjacent ones of said capacitors;

each said loop having at least two first portions, said first portions of each said loop being parallel to each other, and said first portions being perpendicular to said common axis;

at least two second portions connecting said first portions and being disposed in planes skewed to said common axis;

each said loop defining first and second sides, at least one of said first portions of each loop being disposed on said first side, and at least one of said second portions of each loop being disposed on said second side, said first and second sides being oppositely directed with respect to the direction of current flow through said loop;

said first portions of respective loops lying on said first side being spaced from one another by a distance which alternates between smaller and larger values, and said first portions of respective loops lying on said second side being spaced from one another by a distance which alternates between larger and smaller values, such that when said first portions on one of said sides are separated by a distance of said smaller values, said first portions on the other, opposite one of said sides are separated by a distance of said larger value.

2. An electromagnetic delay line according to claim 1, wherein said conductor is wound on the outer periphery of a nonmagnetic bar-shaped bobbin in the shape of a single-layer solenoid, and wherein each said loop is comprised of one turn.

3. An electromagnetic delay line according to claim 1, wherein said conductor is wound on the outer periphery of a nonmagnetic bar-shaped bobbin having a plurality of grooves formed therein, said grooves being perpendicular to a central axis of said bobbin and being parallel to one another, said grooves being formed in an alternating fashion in opposite sides of said bobbin such that adjacent grooves on opposite sides are separated from one another by a predetermined pitch, each said conductor loop being wound in a set of two grooves respectively formed in opposite sides of said bobbin and separated by said predetermined pitch.

4. An electromagnetic delay line according to claim 3, wherein each said loop is comprised of one turn.

5. An electromagnetic delay line according to claim 3, wherein each loop is comprised of a plurality of turns.

6. An electromagnetic delay line, comprising;

an inductance element comprising a conductor winding and a bar-shaped non-magnetic bobbin, said conductor being wound on said bobbin so as to form serially connected conductor loops, said loops each including at least one substantially complete turn, said bobbin defining a central common axis passing through each of said loops;

a plurality of capacitors disposed between said conductor and ground, at least one capacitor being provided at each location between adjacent ones of said loops;

a plurality of conductor sections, each section being defined by a conductor loop arranged between adjacent ones of said capacitors;

each said loop having at least two first portions, said first portions of each said loop being parallel to each other, and said first portions being perpendicular to said common axis;

at least two second portions connecting said first portions and being disposed in planes skewed to said common axis;

each said loop defining first and second sides respectively disposed on first and second sides of said bobbin, at least one of said first portions of each loop being disposed on said first side, and at least one of said second portions of each loop being disposed on said second side;

said bobbin being provided with a plurality of grooves formed therein, said grooves being perpendicular to said central axis and parallel to each other, said grooves being arranged on opposite sides of said bobbin in a staggered manner such that adjacent grooves on opposite sides of said bobbin are spaced at a predetermined pitch, and adjacent grooves on the same side of said bobbin are spaced at double said predetermined pitch, with one said loop being wound in a first pair of adjacent grooves separated by said predetermined pitch, and an adjacent loop being wound in a second pair of adjacent grooves separated by said predetermined pitch, said first pair of grooves and said second pair of grooves including one groove in common.

7. An electromagnetic delay line according to claim 6, wherein each said loop comprises one turn of said conductor.

8. An electromagnetic delay line according to claim 6, wherein each said loop comprises a plurality of turns of said conductor.

9. An electromagnetic delay line as claimed in claim 8, wherein each said loop comprises a spirally wound conductor portion, said spirally wound conductor portion being wound in grooves having a width equal to or slightly greater than a diameter of said conductor.

* * * * *